US010928752B2

(12) United States Patent
Yokoi

(10) Patent No.: US 10,928,752 B2
(45) Date of Patent: Feb. 23, 2021

(54) METHOD OF PRODUCTION OR REPRODUCTION OF ASSEMBLY INCLUDING STORAGE MEDIUM AND HOLDER

(71) Applicant: BROTHER KOGYO KABUSHIKI KAISHA, Nagoya (JP)

(72) Inventor: Junichi Yokoi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/721,893

(22) Filed: Dec. 19, 2019

(65) Prior Publication Data

US 2020/0125007 A1 Apr. 23, 2020

Related U.S. Application Data

(63) Continuation of application No. PCT/JP2018/011009, filed on Mar. 20, 2018.

(30) Foreign Application Priority Data

Jun. 23, 2017 (JP) ..... JP2017-122810

(51) Int. Cl.
*G03G 15/08* (2006.01)

(52) U.S. Cl.
CPC ..... *G03G 15/0894* (2013.01)

(58) Field of Classification Search
CPC ..... G03G 15/0894; G03G 21/1878; G03G 21/1885; G03G 2221/1823
See application file for complete search history.

(56) References Cited

U.S. PATENT DOCUMENTS

2003/0215261 A1* 11/2003 Karakama ..... G03G 21/1871 399/111
2008/0159774 A1 7/2008 Tanabe et al.
(Continued)

FOREIGN PATENT DOCUMENTS

JP 2008-165026 A 7/2008
JP 2013-054058 A 3/2013
(Continued)

OTHER PUBLICATIONS

International Search Report from International Application No. PCT/JP2018/011009, dated Apr. 17, 2018.
(Continued)

*Primary Examiner* — Sandra Brase
(74) *Attorney, Agent, or Firm* — Merchant & Gould P.C.

(57) ABSTRACT

A method of production or reproduction of an assembly is provided. The assembly includes: a storage medium having an electrical contact surface; and a holder holding the electrical contact surface. The holder has: first and second outer surfaces; and an elastic member positioned between the first and second outer surfaces. A separation distance in a first direction between the first and second outer surfaces is changeable in accordance with expansion and contraction of the elastic member. The method includes: reducing the separation distance to a prescribed distance by compressing the elastic member in the first direction; maintaining the separation distance at the prescribed distance; and performing at least one of writing information to, deleting information from, and updating information in the storage medium by bringing a probe into contact with the electrical contact surface in a state where the separation distance is maintained at the prescribed distance.

17 Claims, 9 Drawing Sheets

(56) References Cited

U.S. PATENT DOCUMENTS

| | | | | |
|---|---|---|---|---|
| 2008/0199204 | A1* | 8/2008 | Ishii | G03G 15/0865 399/90 |
| 2010/0142996 | A1 | 6/2010 | Tanabe et al. | |
| 2010/0158563 | A1 | 6/2010 | Tanabe et al. | |
| 2011/0129252 | A1* | 6/2011 | Oda | G03G 21/1871 399/119 |
| 2011/0206412 | A1 | 8/2011 | Tanabe et al. | |
| 2012/0200871 | A1 | 8/2012 | Takahashi et al. | |
| 2013/0051849 | A1 | 2/2013 | Itabashi et al. | |
| 2014/0086597 | A1 | 3/2014 | Tanabe et al. | |
| 2014/0286670 | A1 | 9/2014 | Takahashi et al. | |
| 2014/0314443 | A1 | 10/2014 | Takahashi et al. | |
| 2014/0341602 | A1 | 11/2014 | Takahashi et al. | |
| 2015/0037059 | A1 | 2/2015 | Yang et al. | |
| 2015/0118890 | A1 | 4/2015 | Oshikawa | |
| 2015/0124286 | A1 | 5/2015 | Kim | |
| 2015/0293485 | A1 | 10/2015 | Takahashi et al. | |

FOREIGN PATENT DOCUMENTS

| | | | |
|---|---|---|---|
| JP | 2014-071130 | A | 4/2014 |
| JP | 3196279 | U | 3/2015 |
| JP | 2015-108802 | A | 6/2015 |
| JP | 2016-128933 | A | 7/2016 |

OTHER PUBLICATIONS

Written Opinion from International Application No. PCT/JP2018/011009, dated Apr. 17, 2018.

International Preliminary Report on Patentablitity issued in related International Patent Application No. PCT/JP2018/011009, dated Jan. 2, 2020.

* cited by examiner

METHOD OF PRODUCTION OR REPRODUCTION OF ASSEMBLY INCLUDING STORAGE MEDIUM AND HOLDER

CROSS REFERENCE TO RELATED APPLICATION

This application is a by-pass continuation of International Application No. PCT/JP2018/011009 filed Mar. 20, 2018 claiming a priority from Japanese Patent Application No. 2017-122810 filed Jun. 23, 2017. The entire contents of the priority application and the International Application are incorporated herein by reference.

TECHNICAL FIELD

The present disclosure relates to a method of production or reproduction of an assembly including a storage medium and a holder.

BACKGROUND

Electrophotographic image-forming apparatuses such as laser printers, LED printers and the like are well known in the art. The conventional image-forming apparatuses employ a developing cartridge. The developing cartridge has a developing roller for supplying developer.

The conventional developing cartridge is attached to a drum cartridge. The drum cartridge has a photosensitive drum. The drum cartridge is attached to the image-forming apparatus in a state where the developing cartridge is attached to the drum cartridge.

SUMMARY

Conventional developing cartridges including a storage medium are also known in the art. The storage medium is an IC chip, for example. The storage medium has electrical contact surfaces. The electrical contact surfaces of the storage medium are in contact with terminal parts in the image-forming apparatus. The storage medium is held by a holder. A holder capable of expanding and contracting may be used for pressing the electrical contact surfaces of the storage medium against the terminal parts of the image-forming apparatus. Specifically, the holder may have a first outer surface in which the electrical contact surfaces are held, a second outer surface on the opposite side from the first outer surface, and an elastic member capable of expanding and contracting positioned between the first outer surface and the second outer surface.

However, the position of the first outer surface is unstable in a case where this type of holder capable of expanding and contracting is used. Consequently, it is difficult to perform at least one of writing information to, deleting information from, and updating information in the IC chip when producing or reproducing the developing cartridge.

It is an object of the present invention to perform at least one of writing information to, deleting information from, and updating information in the storage medium in a state where the position of the electrical contact surfaces in a first direction crossing the electrical contact surfaces is stabilized when the holder holding the electrical contact surfaces is capable of expanding and contracting in the first direction.

In view of the foregoing, it is an object of the present disclosure to provide a method of production or reproduction of an assembly. The assembly includes: a storage medium; and a holder. The storage medium has an electrical contact surface. The holder is configured to hold the electrical contact surface. The holder has: a first outer surface; a second outer surface; and an elastic member. The first outer surface is positioned at one side in a first direction intersecting the electrical contact surface. The first outer surface is configured to hold the electrical contact surface. The second outer surface is positioned at another side in the first direction. The second outer surface is apart from the first outer surface in the first direction. The elastic member is positioned between the first outer surface and the second outer surface. The elastic member is configured to expand and contract in the first direction. A separation distance in the first direction between the first outer surface and the second outer surface is changeable between a first distance and a second distance shorter than the first distance in accordance with expansion and contraction of the elastic member. The method includes: reducing the separation distance to a prescribed distance shorter than the first distance by compressing the elastic member in the first direction; maintaining the separation distance at the prescribed distance; and performing at least one of writing information to, deleting information from, and updating information in the storage medium by bringing a probe into contact with the electrical contact surface in a state where the separation distance is maintained at the prescribed distance.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Next, an embodiment of the present disclosure will be described while referring to the accompanying drawings. In the following description, a direction crossing electrical contact surfaces of an IC chip will be referred to as "first direction." Further, a direction between one side of a casing of the developing cartridge in which a developing roller is positioned and the opposite side of the casing will be referred to as "second direction." Further, a direction in which the casing of the developing cartridge extends will be referred to as "third direction." The first direction and the second direction cross each other (and preferably are orthogonal to each other). The second direction and the third direction cross each other (and preferably are orthogonal to each other). The third direction and the first direction cross each other (and preferably are orthogonal to each other).

<1. Overall Structure of Image-Forming Apparatus>

Figure 1:
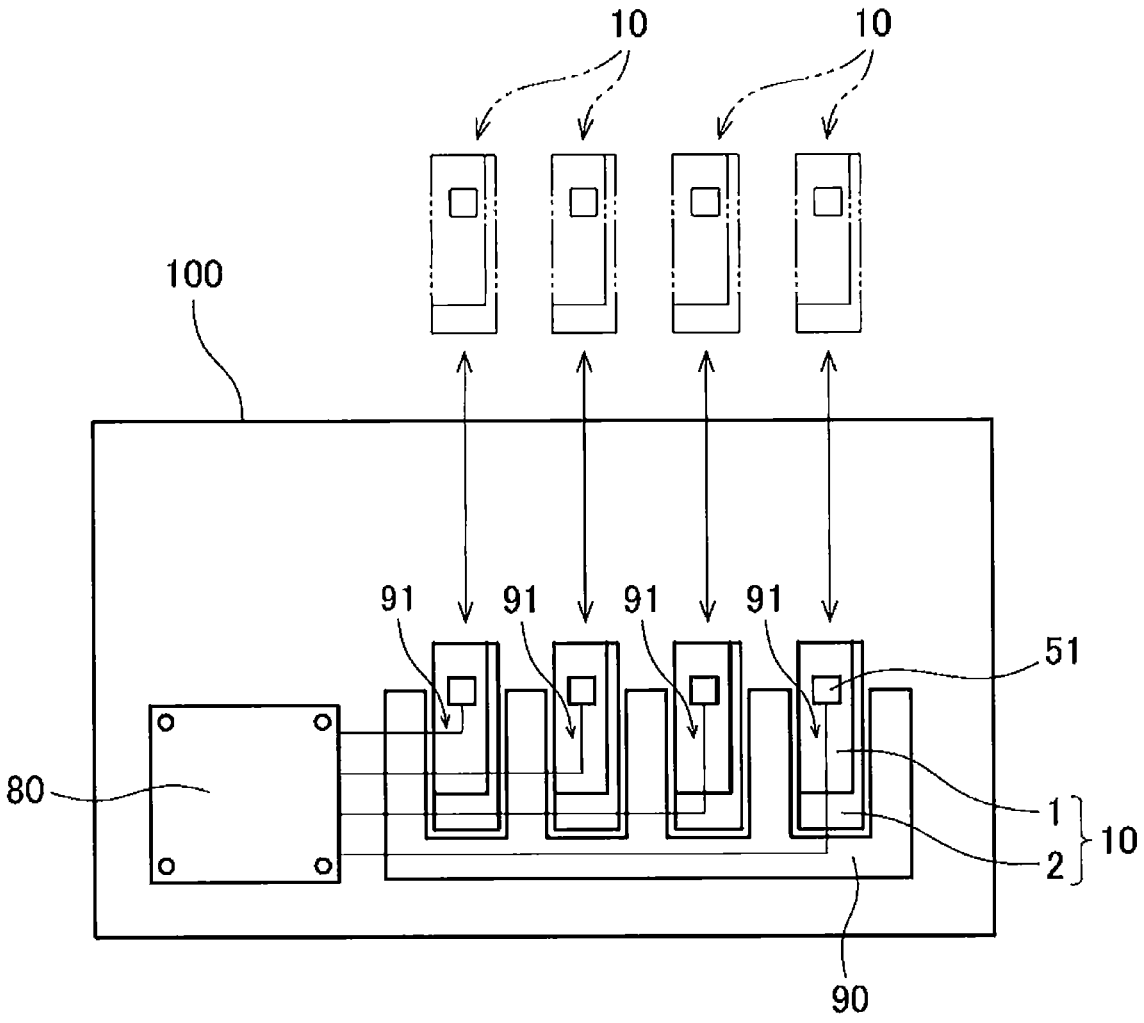
FIG. 1 is a conceptual diagram illustrating an image-forming apparatus.

FIG. 1 is a conceptual diagram illustrating an image-forming apparatus 100. This image-forming apparatus 100 is an electrophotographic printer. A laser printer and an LED printer are examples of the image-forming apparatus 100.

The image-forming apparatus 100 includes four process cartridges 10 and a process-cartridge holder 90. Each process cartridge 10 includes a developing cartridge 1 and a drum cartridge 2. The developing cartridge 1 is attachable to the drum cartridge 2. The four developing cartridges 1 respectively accommodate therein developing agents of different colors (for example, cyan, magenta, yellow, and black). However, the number of the developing cartridge(s) 1 may be any one of one through three, and can be five or more. The process-cartridge holder 90 is a frame to which the process cartridges 10 are attachable. The process-cartridge holder 90 has four slots 91. Each process cartridge 10 can be attached to each slot 91. The image-forming apparatus 100 is configured to form an image on a recording surface of a printing sheet by the developing agents (such as toner) supplied from the four developing cartridges 1 of the four process cartridges 10.

Each of the four developing cartridges 1 includes an IC chip 51. The IC chip 51 is a storage medium from which information is readable and to which information is writable. The image-forming apparatus 100 also includes a controller 80. The IC chip 51 of each developing cartridge 1 is electrically connected to the controller 80 as a result of attachment of the process cartridge 10 to the slot 91 of the process-cartridge holder 91. The controller 80 is constituted by, for example, a circuit board. The controller 80 includes a processor such as a CPU and the like and various memories. The controller 80 controls various processes executed in the image-forming apparatus 100 by operations of the processor in accordance with programs.

<2. Process Cartridge>

<2-1. Developing Cartridge>

Figure 2:
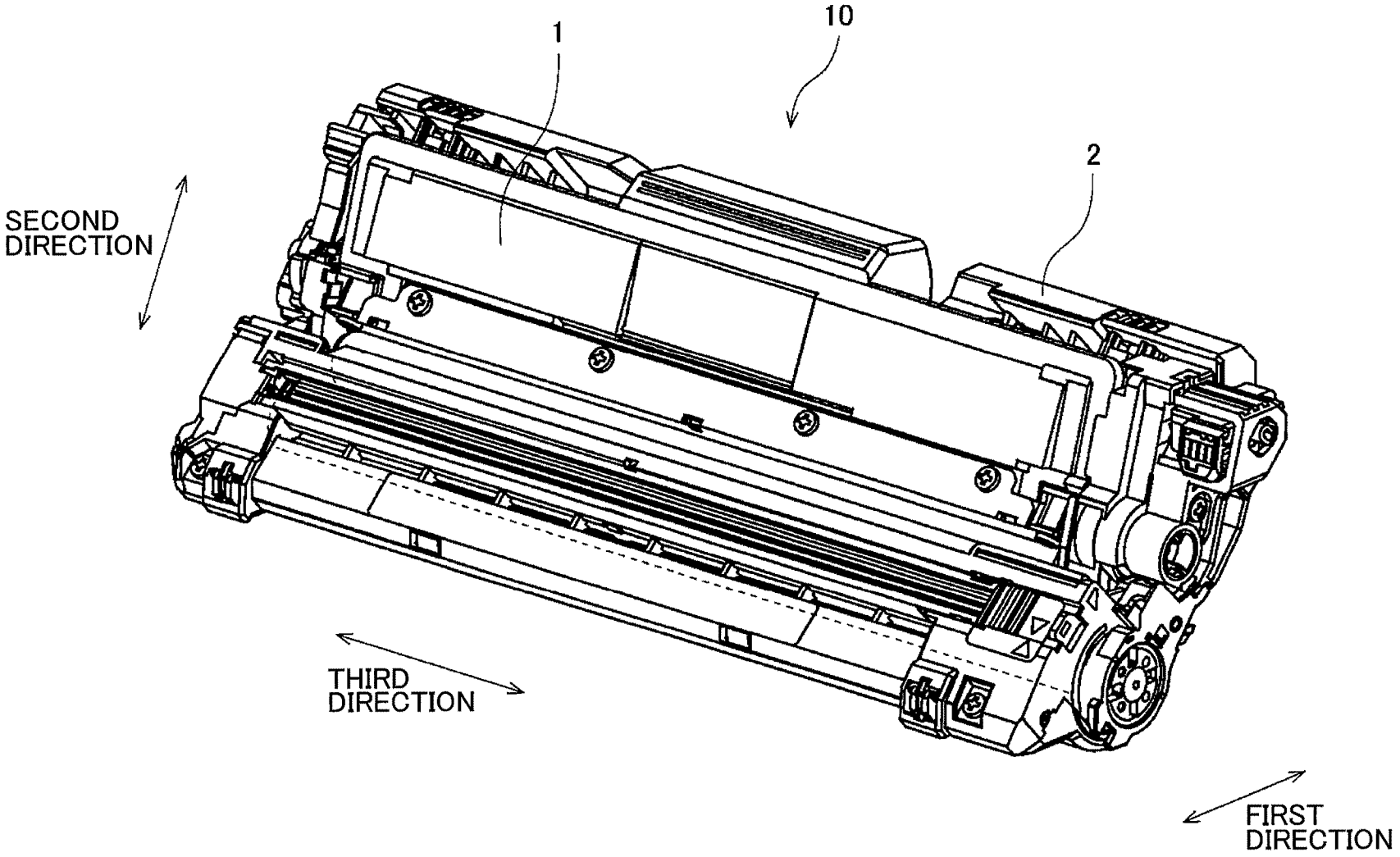
FIG. 2 is a perspective view of a process cartridge.

FIG. 2 is a perspective view of the process cartridge 10. As described above, the process cartridge 10 includes the developing cartridge 1 and the drum cartridge 2. The developing cartridge 1 is attachable to and detachable from the drum cartridge 2. The user of the image-forming apparatus 100 can replace any one of the developing cartridge 1 and the drum cartridge 2 with a new cartridge. Accordingly, each product life of the developing cartridge 1 and the drum cartridge 2 can be effectively consumed.

Figure 3:
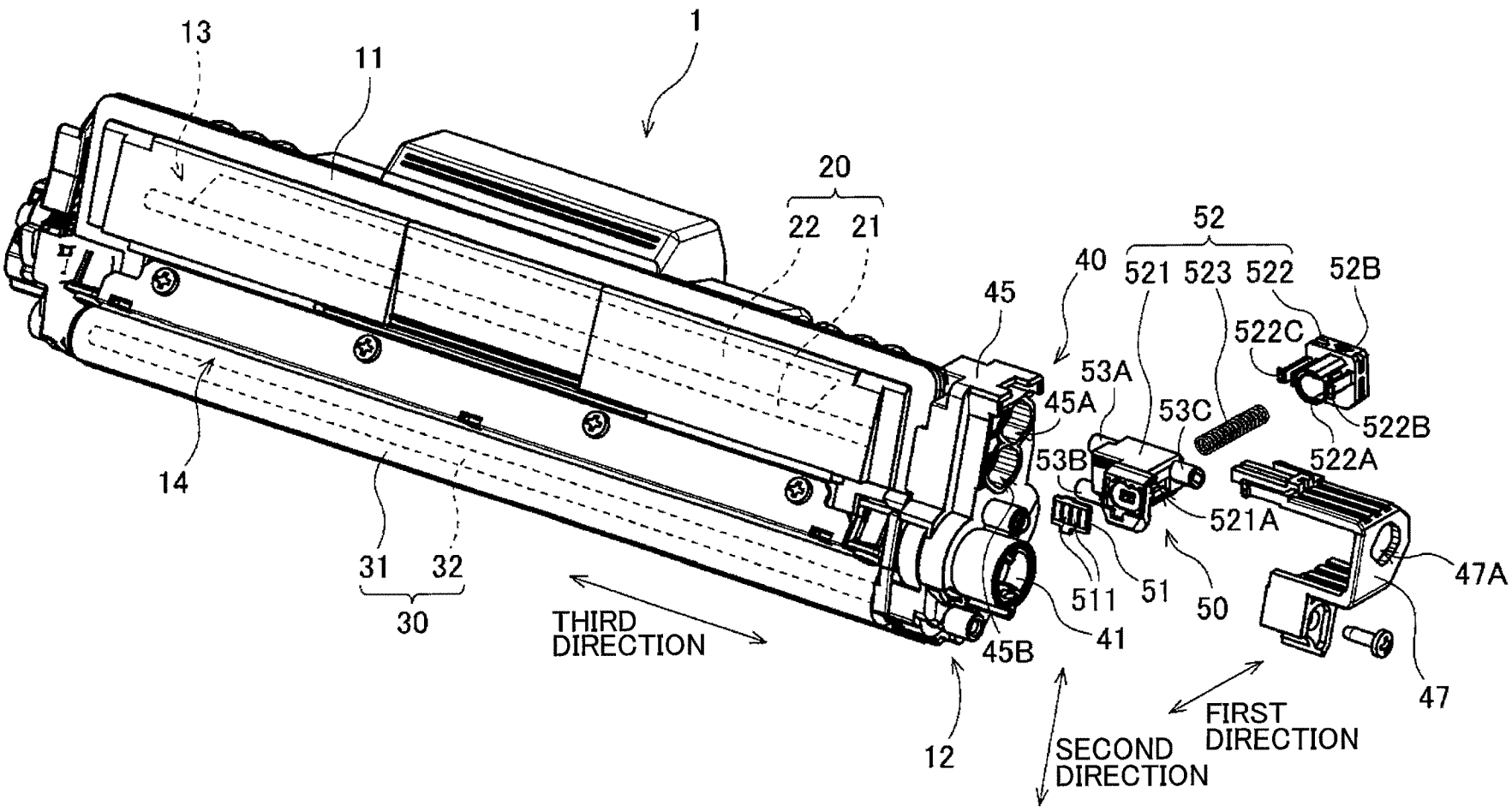
FIG. 3 is a perspective view of a developing cartridge.

FIG. 3 is a perspective view of the developing cartridge 1. FIG. 3 illustrates a partially exploded view of the developing cartridge 1. As illustrated in FIG. 3, the developing cartridge 1 includes: a casing 11; an agitator 20; a developing roller 30; a gear portion 40; and an IC chip assembly 50.

The casing 11 is a casing configured to accommodate a developing agent. The casing 11 extends in the third direction. An accommodation chamber 13 is provided in an interior of the casing 11. The developing agent is accommodated in the accommodation chamber 13. The casing 11 has an opening 14. The opening 14 is positioned at one end portion of the casing 11 in the second direction. The accommodation chamber 13 communicates with an outside of the casing 11 through the opening 14.

The agitator 20 includes an agitator shaft 21 and an agitation blade 22. The agitator shaft 21 extends in the third direction. The agitation blade 22 extends radially outward from the agitator shaft 21. At least part of the agitator shaft 21 and the agitation blade 22 are positioned inside the accommodation chamber 13. The gear portion 40 includes an agitator gear connected to one end portion of the agitator shaft 21 in the third direction. The agitator shaft 21 and the agitation blade 22 rotate along with rotation of the agitator gear. In accordance with rotation of the agitation blade 22, the developing agent in the accommodation chamber 13 is agitated.

The developing roller 30 is a roller rotatable about a rotation axis (first rotation axis) extending in the third direction. The developing roller 30 is positioned at the opening 14 of the casing 11. That is, the developing roller 30 is positioned at the one end portion of the casing 11 in the second direction. The developing roller 30 of the present embodiment includes a developing-roller body 31 and a developing-roller shaft 32. The developing-roller body 31 is a hollow cylindrical member extending in the third direction. The developing-roller shaft 32 is made from material such as rubber having elasticity, for example. The developing-roller shaft 32 is a solid cylindrical member extending through the developing-roller body 31 in the third direction. The developing-roller shaft 32 is made from material such as metal or electrically conductive resin. The developing-roller body 31 is fixed to the developing-roller shaft 32 so as not to rotate relative to the developing-roller shaft 32.

The gear portion 40 includes a developing-roller gear to which one end portion of the developing-roller shaft 32 in the third direction is fixed so as not to rotate relative to the developing roller gear. That is, the developing-roller shaft 32 rotates by the rotation of the developing-roller gear, and the developing-roller body 31 also rotates along with the developing-roller shaft 32.

Note that the developing-roller shaft 32 does not necessarily penetrate the developing-roller body 31 in the third direction. For example, a pair of developing-roller shafts 32 may extend in the third direction from both ends of the developing-roller body 31 in the third direction, respectively.

The developing cartridge 1 further includes an unillustrated supply roller. The supply roller is positioned between the developing roller 30 and the accommodation chamber 13. The supply roller is rotatable about a rotation axis extending in the third direction. The developing agent accommodated in the accommodation chamber 13 of the casing 11 is supplied to an outer peripheral surface of the developing roller 30 through the supply roller upon receipt of driving force in the developing cartridge 1. During the supply of the developing agent, the developing agent is tribo-electrically charged between the supply roller and the developing roller 30. On the other hand, a bias voltage is applied to the developing-roller shaft 32 of the developing roller 30. Therefore, the developing agent is attracted to the outer peripheral surface of the developing-roller body 31 by an electrostatic force between the developing-roller shaft 32 and the developing agent.

The developing cartridge 1 further includes an unillustrated layer-thickness regulation blade. The layer-thickness regulation blade is configured to regulate the developing agent supplied over the outer peripheral surface of the developing-roller body 31 into a uniform thickness. Then, the developing agent on the outer peripheral surface of the developing-roller body 31 is supplied to a photosensitive drum 72 described later. In this instance, the developing agent moves from the developing-roller body 31 to the photosensitive drum 72 according to an electrostatic latent image formed on the outer peripheral surface of the photosensitive drum 72. Hence, the electrostatic latent image is developed into a visible image on the outer peripheral surface of the photosensitive drum 72.

The gear portion 40 is positioned at a first end face 12, which is one end face of the casing 11 in the third direction. The gear portion 40 includes: a plurality of gears including the above-described agitator gear and developing-roller gear; a coupling 41; and a gear cover 45. The gear cover 45 is fixed to the first end face 12 of the casing 11 by, for example, screws. At least part of the plurality of gears is positioned between the first end face 12 and the gear cover 45. The coupling 41 is exposed to the outside of the gear cover 45. Upon attachment of the process cartridge 10 to the image-forming apparatus 100, a drive shaft of the image-forming apparatus 100 is coupled with the coupling 41. Hence, rotation of the drive shaft is transmitted via the coupling 41 to the plurality of gears including the agitator gear and the developing-roller gear.

The developing cartridge 1 further includes a holder cover 47. The holder cover 47 is fixed to the gear cover 45. The holder cover 47 is positioned opposite to the casing 11 with respect to the gear cover 45 in the third direction.

Note that the plurality of gears of the gear portion 40 may be gears configured to transmit a rotation force by meshing engagements of teeth or gears configured to transmit a rotation force by friction between the gears.

Figure 4:
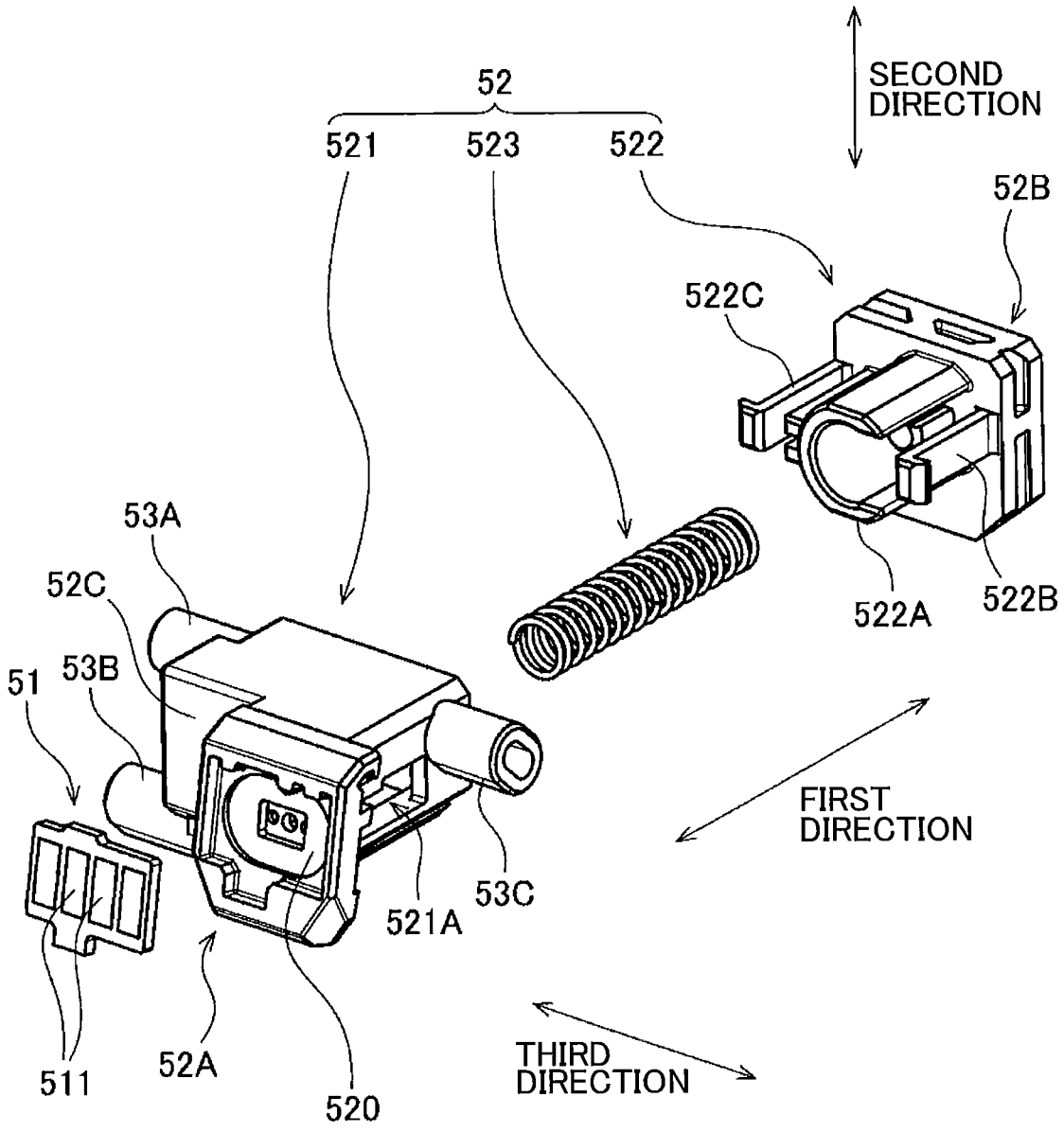
FIG. 4 is an exploded perspective view of an IC chip assembly.

The IC chip assembly 50 is attached to the casing 11. FIG. 4 is an exploded perspective view of the IC chip assembly 50. As illustrated in FIG. 4, the IC chip assembly 50 includes: the IC chip 51 as a storage medium; and a holder 52 configured to hold the IC chip 51. The IC chip 51 has four electrical contact surfaces 511. Each electrical contact surface 511 is made from electrically conductive metal. Further, the IC chip 51 is configured to store various information on the developing cartridge 1. However, the number of the electrical contact surface(s) 511 of the IC chip 51 may be one through three, or can be five or more.

The holder 52 has a first outer surface 52A and a second outer surface 52B. The first outer surface 52A is positioned at one end of the holder 52 in the first direction. The second outer surface 52B is positioned at another end of the holder 52 in the first direction. The first outer surface 52A is movable in the first direction relative to the second outer surface 52B.

More specifically, the holder 52 of the present embodiment includes: a first holder member 521; a second holder member 522; and a coil spring 523 interposed therebetween. The first holder member 521 is made from resin, for example. The second holder member 522 is made from resin, for example. The first holder member 521 has the first outer surface 52A. The IC chip 51 is fixed to a holding surface 520 included in the first outer surface 52A. Hence, the electrical contact surfaces 511 of the IC chip 51 are held by the first outer surface 52A. The second holder member 522 has the second outer surface 52B. Upon assembly of the holder 52, the first outer surface 52A and the second outer surface 52B are away from each other in the first direction.

The coil spring 523 is an elastic member configured to expand and contract in the first direction. The coil spring 523 is positioned between the first outer surface 52A and the second outer surface 52B in the first direction. One end of the coil spring 523 in the first direction may be directly connected to the first holder member 521 or may be indirectly connected to the first holder member 521 via another member. Further, another end of the coil spring 523 in the first direction may be directly connected to the second holder member 522 or may be indirectly connected to the second holder member 522 via another member. The distance in the first direction between the first outer surface 52A and the second outer surface 52B changes as the coil spring 523 expands and contracts. The distance in the first direction between the first outer surface 52A and the second outer surface 52B is an example of a separation distance.

The length of the coil spring 523 in the first direction changes at least between a first length and a second length shorter than the first length. When the coil spring 523 is at the first length, the distance in the first direction between the first outer surface 52A and the second outer surface 52B is a first distance. When the coil spring 523 is at the second length, the distance in the first direction between the first outer surface 52A and the second outer surface 52B is a second distance shorter than the first distance. The second length is at least shorter than the natural length of the coil spring 523.

As illustrated in FIG. 4, the second holder member 522 includes a cylindrically shaped spring holder 522A. The spring holder 522A protrudes toward the first holder member 521 in the first direction from the surface of the second holder member 522 facing the first holder member 521. A portion of the coil spring 523 is inserted inside the spring holder 522A. Note that the second holder member 522 has a columnar-shaped protruding part (not illustrated) inside the spring holder 522A. Therefore, the coil spring 523 is supported by the outer circumferential surface of the protruding part and the inner circumferential surface of the spring holder 522A.

The second holder member 522 also has a first pawl portion 522B and a second pawl portion 522C. The first pawl portion 522B extends toward the first holder member 521 in the first direction from the surface of the second holder member 522 facing the first holder member 521. The distal end of the first pawl portion 522B protrudes in a direction crossing the first direction. The second pawl portion 522C also extends toward the first holder member 521 in the first direction from the surface of the second holder member 522 facing the first holder member 521. The distal end of the second pawl portion 522C protrudes in a direction crossing the first direction. The first holder member 521 has a first opening 521A. The distal end of the first pawl portion 522B is inserted into the first opening 521A. On the other hand, the first holder member 521 has a second opening (not illustrated). The distal end of the second pawl portion 522C is inserted into the second opening.

When the coil spring 523 is at the first length, the first pawl portion 522B is made in contact with the first holder member 521 at the edge of the first opening 521A on the second outer surface 52B side. Further, when the coil spring 523 is at the first length, the second pawl portion 522C is made in contact with the first holder member 521 at the edge of the second opening on the second outer surface 52B side. In this way, the coil spring 523B is prevented from being made longer in the first direction than the first length. In addition, disengagement of the first holder member 521 from the second holder member 522 is prevented.

When the coil spring 523 is at the second length, on the other hand, the first pawl portion 522B is made in contact with the first holder member 521 at the edge of the first opening 521A on the first outer surface 52A side. Further, when the coil spring 523 is at the second length, the second pawl portion 522C is made in contact with the first holder member 521 at the edge of the second opening on the first outer surface 52A side. In this way, the coil spring 523 is prevented from being made shorter in the first direction than the second length.

The IC chip 51 is fixed to the holding surface 520 included in the first outer surface 52A of the first holder member 521. Hence, movement of the first holder member 521 in the first direction relative to the second holder member 522 causes the electrical contact surfaces 511 of the IC chip 51 to move in the first direction. Note that the first outer surface 52A in the present embodiment has a recessed part that is recessed toward the second holder member 522 in the first direction. The holding surface 520 is positioned in this recessed part.

Further, as illustrated in FIG. 4, the first holder member 521 includes: a first boss 53A; a second boss 53B; and a third boss 53C. Each of the first boss 53A and the second boss 53B extends in the third direction toward the gear cover 45 from a surface of the first holder member 521 facing the gear cover 45. On the other hand, the gear cover 45 has a first through-hole 45A and a second through-hole 45B. Each of the first through-hole 45A and the second through-hole 45B penetrates the gear cover 45 in the third direction. The first boss 53A is inserted into the first through-hole 45A. The second boss 53B is inserted into the second through-hole 45B.

The third boss 53C extends in the third direction toward the holder cover 47 from another surface of the first holder member 521 facing the holder cover 47. On the other hand, the holder cover 47 has a third through-hole 47A. The third through-hole 47A penetrates the holder cover 47 in the first direction. The third boss 63C is inserted into the third through-hole 47A.

The first through-hole 45A has a dimension (inner dimension) in the first direction that is greater than a dimension (outer dimension) in the first direction of the first boss 53A. The second through-hole 45B has a dimension (inner dimension) in the first direction that is greater than a dimension (outer dimension) in the first direction of the second boss 53B. The third through-hole 47A has a dimension (inner dimension) in the first direction that is greater than a dimension (outer dimension) in the first direction of the third boss 53C. Accordingly, the holder 52 is movable together with the first boss 53A, the second boss 53B, and the third boss 53C in the first direction relative to the gear cover 45 and the holder cover 47. When the holder 52 moves in the first direction, the IC chip 51 having the electrical contact surfaces 511 also moves together with the holder 52 in the first direction.

The first through-hole 45A has a dimension (inner dimension) in the second direction that is greater than a dimension (outer dimension) in the second direction of the first boss 53A. The second through-hole 45B has a dimension (inner dimension) in the second direction that is greater than a dimension (outer dimension) in the second direction of the second boss 53B. The third through-hole 47A has a dimension (inner dimension) in the second direction that is greater than a dimension (outer dimension) in the second direction of the third boss 53C. Accordingly, the holder 52 is movable together with the first boss 53A, the second boss 53B, and the third boss 53C in the second direction relative to the gear cover 45 and the holder cover 47. When the holder 52 moves in the second direction, the IC chip 51 having the electrical contact surfaces 511 also moves together with the holder 52 in the second direction.

Note that the gear cover 45 may have, instead of the first through-hole 45A, a recessed portion into which the first boss 53A can be inserted. Further, the gear cover 45 may have, instead of the second through-hole 45B, a recessed portion into which the second boss 53B can be inserted. The holder cover 47 may have, instead of the third through-hole 47A, a recessed portion into which the third boss 53C can be inserted. Further, the gear cover 45 may have a boss, and the first holder member 521 may have a through-hole or a recessed portion into which the boss can be inserted. The holder cover 47 may have a boss, and the first holder member 521 may have a through-hole or a recessed portion into which the boss can be inserted.

That is, one of the casing configured of the casing 11, the gear cover 45, and the holder cover 47, and the holder 52 may have a boss, and another of the casing and the holder 52 may have a through-hole or a recessed portion into which the boss can be inserted.

<2-2. Drum Cartridge>

Figure 5:
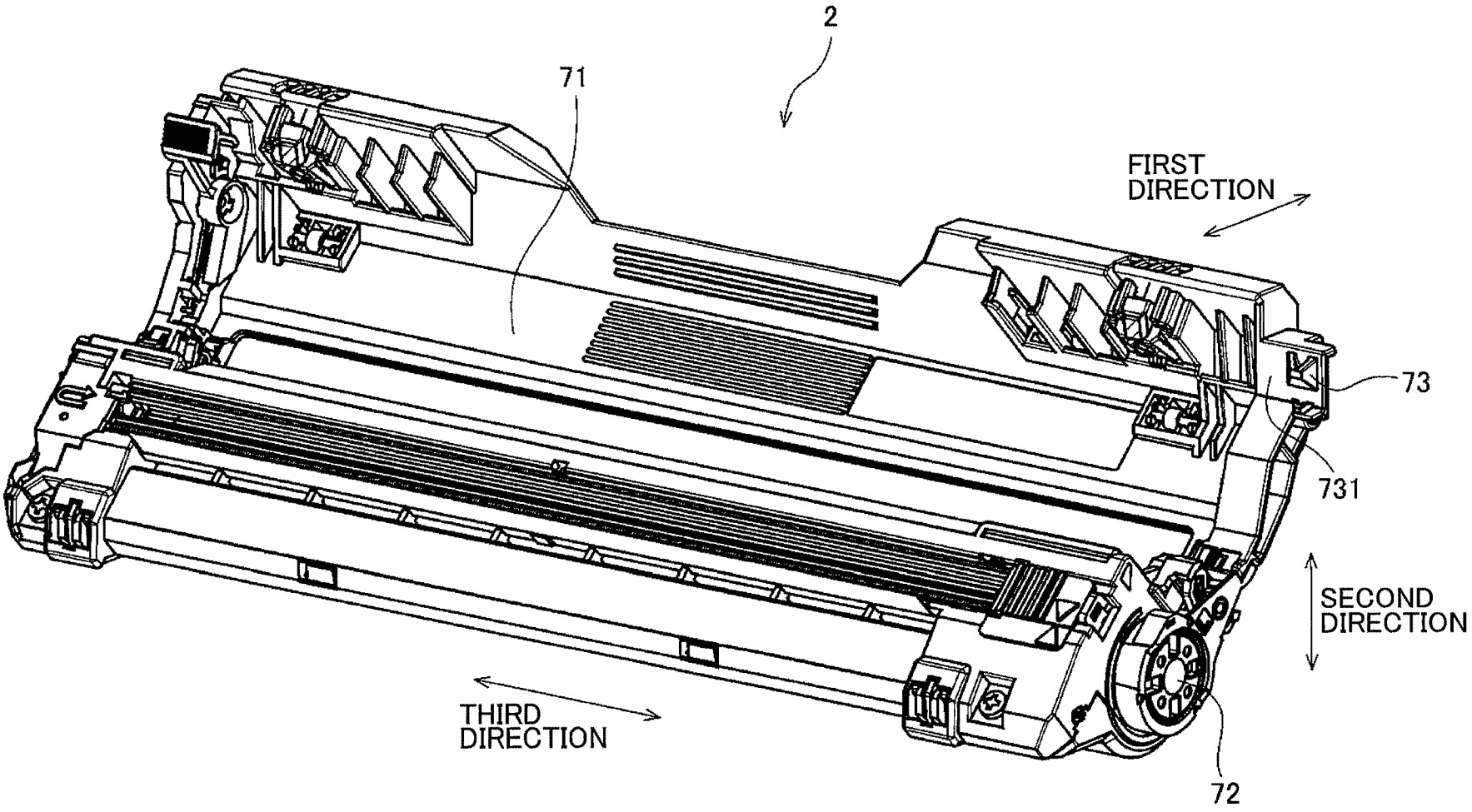
FIG. 5 is a perspective view of a drum cartridge.

FIG. 5 is a perspective view of the drum cartridge 2. The drum cartridge 2 includes a single developing-cartridge holding portion 71 for holding a single developing cartridge 1. The photosensitive drum 72 is positioned at the developing-cartridge holding portion 71. The photosensitive drum 72 is rotatable about a rotation axis (second rotation axis) extending in the third direction. The developing roller 30 of the developing cartridge 1 comes in contact with the photosensitive drum 72 as a result of attachment of the developing cartridge 1 to the drum cartridge 2. The drum cartridge 2 to which the developing cartridge 1 is attached is attached to the process-cartridge holder 90 (see FIG. 1) provided in the image-forming apparatus 100.

A holding plate 731 is provided at one end portion of the developing-cartridge holding portion 71 in the third direction. The holding plate 731 is positioned such that the second outer surface 52B of the holder 52 faces the holding plate 731 in the first direction in a state where the developing cartridge 1 is attached to the drum cartridge 2. The holding plate 731 has a surface extending in the second direction and the third direction. The holding plate 731 also has a protruding portion 73. The protruding portion 73 protrudes toward the holder 52 in the first direction from the holding plate 731. Further, protruding portion 73 converges toward the holder 52 in the shape of a quadrangular pyramid.

Figure 7:
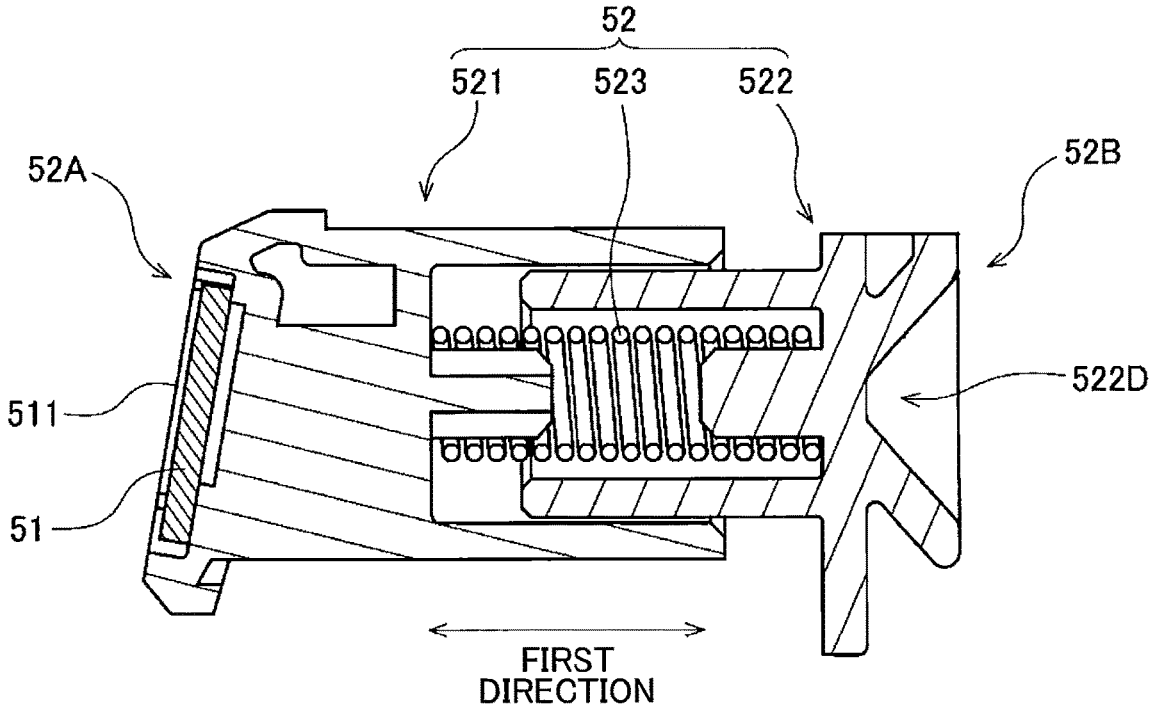
FIG. 7 is a cross-sectional view of a holder prior to being compressed in a first direction.
Figure 8:
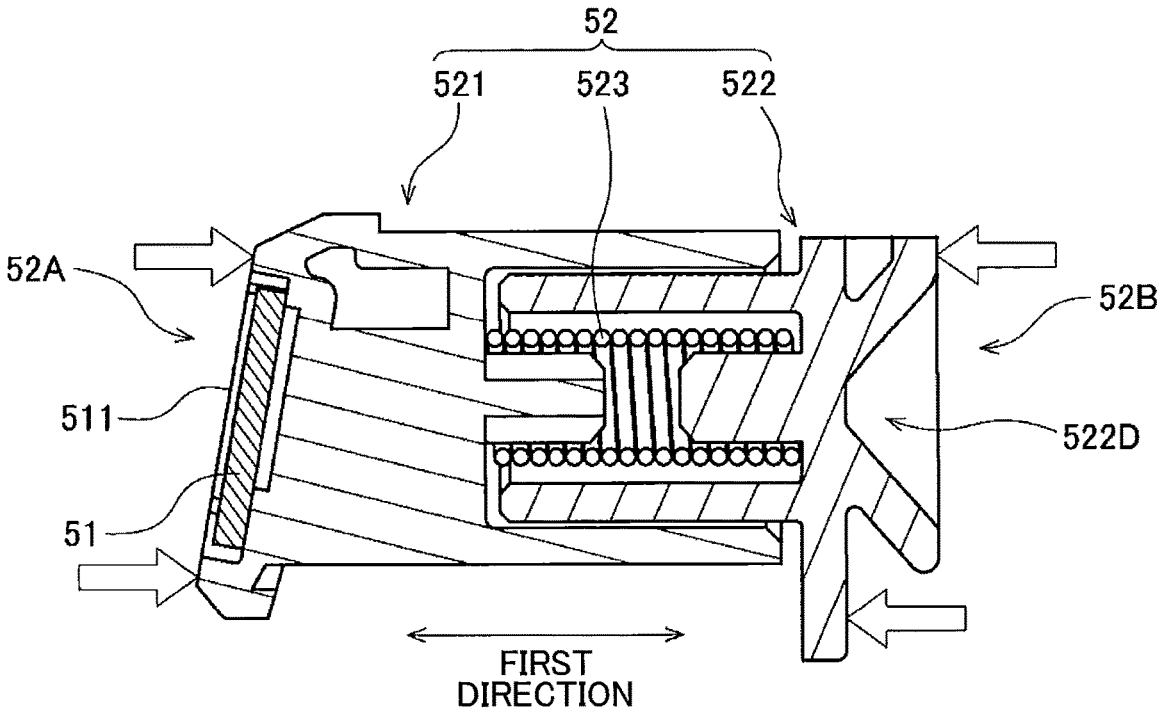
FIG. 8 is a cross-sectional view of the holder when compressed in the first direction.
Figure 9:
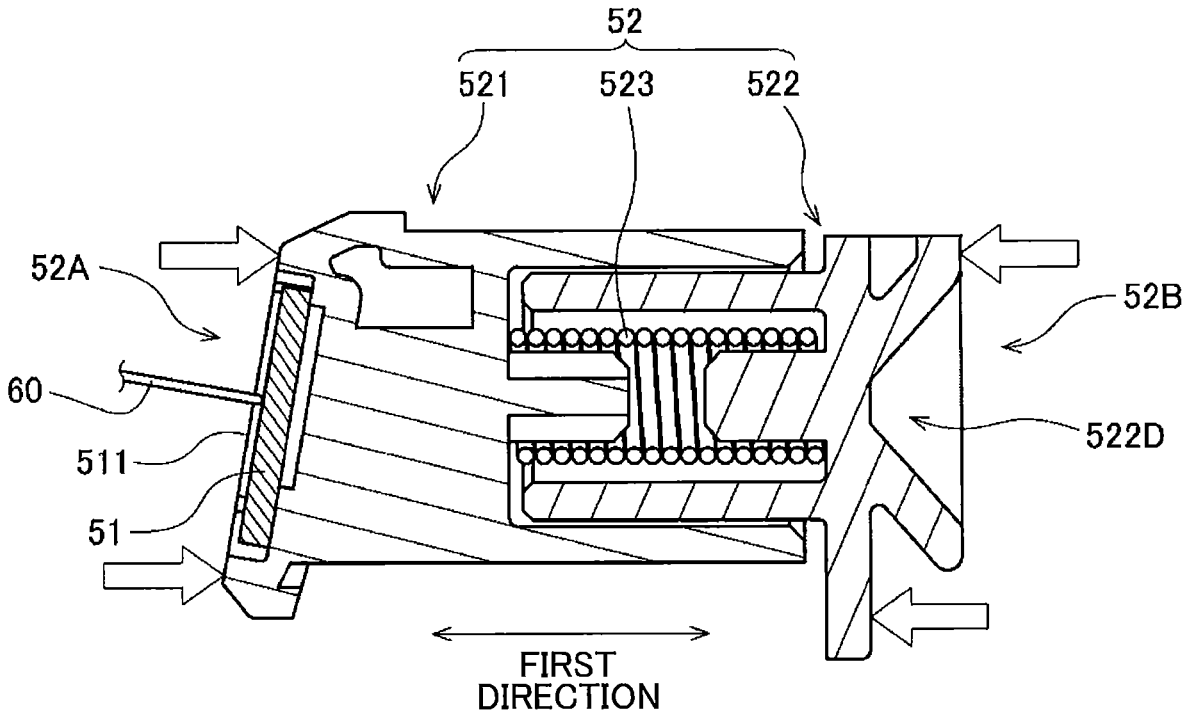
FIG. 9 is a cross-sectional view of the holder when information is being written to an IC chip.

The second holder member 522 of the IC chip assembly 50 has a cavity 522D in the second outer surface 52B (see FIGS. 7 through 9). The cavity 522D is recessed from the second outer surface 52B toward the first holder member 521. The cavity 522D also converges toward the first holder member 521 in the shape of a quadrangular pyramid.

In a state where the developing cartridge 1 is attached to the drum cartridge 2, the protruding portion 73 of the drum cartridge 2 is fitted with the cavity 522D of the second holder member 522. Then, the holding plate 731 is made in contact with the second outer surface 52B of the second holder member 522. That is, the holding plate 731 and the protruding portion 73 function as a holder supporting portion for holding the holder 52 of the IC chip assembly 50.

<3. Production Procedure for Developing Cartridge>

Figure 6:
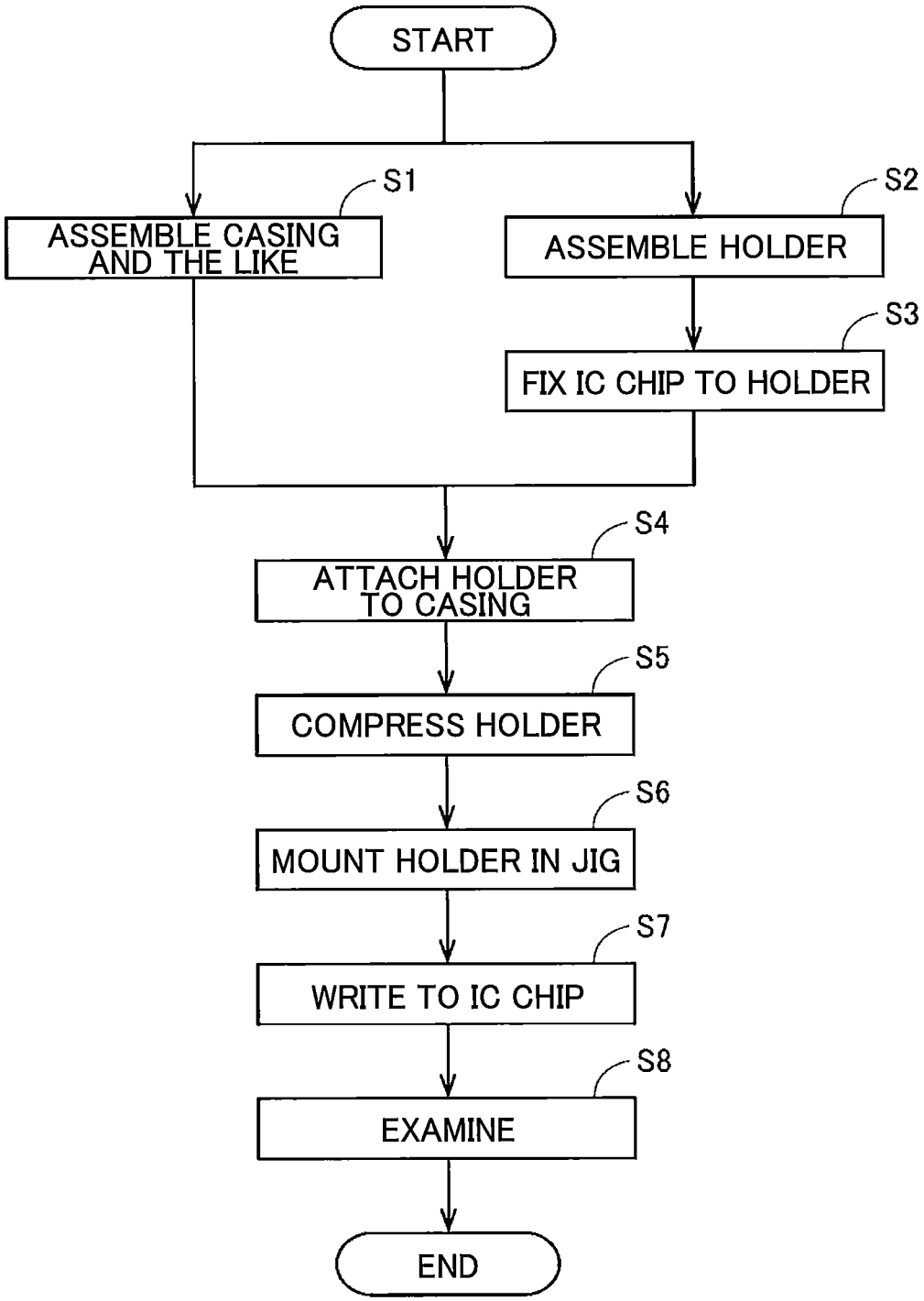
FIG. 6 is a flowchart illustrating a production procedure for the developing cartridge.

Next, a production procedure for the above-described developing cartridge 1 will be described. FIG. 6 is a flowchart illustrating the production procedure for the developing cartridge 1. The production procedure in FIG. 6 includes a production procedure for the IC chip assembly 50. Each of the following steps may be performed manually by the manufacturer or may be performed using automated equipment.

When producing the developing cartridge 1, first the manufacturer assembles the casing 11, the agitator 20, the developing roller 30, and the gear portion 40 (step S1). The manufacturer also assembles the holder 52 of the IC chip assembly 50 (step S2). Next, the manufacturer fixes the IC chip 51 having the electrical contact surfaces 511 to the first outer surface 52A of the holder 52 (step S3). However, the manufacturer may perform step S1 after steps S2 and S3 or may perform step S1 at the same time as steps S2 and S3.

After completing steps S1-S3, the manufacturer attaches the holder 52 to the casing 11 (step S4). In the present embodiment, the manufacturer attaches the holder 52 to the gear cover 45, which is fixed to the casing 11. Specifically, the first boss 53A of the holder 52 is inserted into the first through-hole 45A of the gear cover 45. In addition, the second boss 53B of the holder 52 is inserted into the second through-hole 45B of the gear cover 45. Next, the holder cover 47 is attached to the gear cover 45, with the third boss 53C of the holder 52 being inserted through the third through-hole 47A of the holder cover 47.

Next, the manufacturer compresses the holder 52 in the first direction (step S5). That is, the manufacturer applies an external force to each of the first outer surface 52A of the first holder member 521 and the second outer surface 52B of the second holder member 522 in directions for bringing the first outer surface 52A and the second outer surface 52B toward each other. Through this operation, the length of the coil spring 523 in the first direction is compressed from the first length to a prescribed length shorter than the first length. As a result, the distance in the first direction between the first outer surface 52A and the second outer surface 52B changes from the first distance to a prescribed distance shorter than the first distance.

Next, the manufacturer mounts the holder 52 in a jig while maintaining the distance in the first direction between the first outer surface 52A and the second outer surface 52B at the prescribed distance (step S6). FIG. 7 is a cross-sectional view of the holder 52 prior to being compressed in the first direction. FIG. 8 is a cross-sectional view of the holder 52 when compressed in the first direction. As indicated by the arrows depicted in outline in FIG. 8, the jig presses at least one of the first outer surface 52A and the second outer surface 52B of the holder 52 in the first direction. Hence, the length of the coil spring 523 in the first direction is maintained at the prescribed length. Accordingly, the distance in the first direction between the first outer surface 52A and the second outer surface 52B is maintained at the prescribed distance.

The jig presses portions of the first outer surface 52A encompassing the electrical contact surfaces 511. In other words, the jig presses portions of the first outer surface 52A not covered by the electrical contact surfaces 511. Hence, contact between the jig and the electrical contact surfaces 511 can be avoided. As illustrated in FIG. 4, the first outer surface 52A in the present embodiment has a step surface 52C. The step surface 52C is positioned between the holding surface 520 that holds the electrical contact surfaces 511 and the casing 11 in the third direction. The step surface 52C extends in the second direction and the third direction. The jig presses this step surface 52C, for example.

The "prescribed distance" described above may be the second distance, for example. In other words, the manufacturer may reduce the distance in the first direction between the first outer surface 52A and the second outer surface 52B to the second distance, for example. When the distance in the first direction between the first outer surface 52A and the second outer surface 52B is the second distance, the length of the coil spring 523 in the first direction is the second length. Then, the distal end of the first pawl portion 522B is made in contact with the first holder member 521 at the edge of the first opening 521A on the first outer surface 52A side. In addition, the distal end of the second pawl portion 522C is made in contact with the first holder member 521 at the edge of the second opening on the first outer surface 52A side. Hence, the positions of the electrical contact surfaces 511 in the first direction are stable. Note that the distal end of the spring holder 522A may contact the first holder member 521 when the distance in the first direction between the first outer surface 52A and the second outer surface 52B is the second distance.

Alternatively, the "prescribed distance" described above may be a distance shorter than the first distance and longer than the second distance. In other words, the manufacturer may reduce the distance in the first direction between the first outer surface 52A and the second outer surface 52B to a distance shorter than the first distance and longer than the second distance. Setting the distance in the first direction between the first outer surface 52A and the second outer surface 52B to a distance greater than the second distance can stabilize the positions of the electrical contact surfaces 511 in the first direction in a case where large dimensional errors exist in the first opening 521A, the first pawl portion 522B, the second opening, or the second pawl portion 522C.

Thereafter, the manufacturer writes information to the IC chip 51 in a state where the holder 52 remains mounted in the jig (step S7). FIG. 9 is a cross-sectional view of the holder 52 when information is being written to the IC chip 51. As illustrated in FIG. 9, a probe 60 is in contact with the electrical contact surfaces 511 when writing information to the IC chip 51. In this way, information is written to a memory in the IC chip 51 via the electrical contact surfaces 511. The probe 60 may be oriented perpendicularly to the electrical contact surfaces 511, as illustrated in FIG. 9, or may be oriented obliquely to the electrical contact surfaces 511. As described above, the distance in the first direction between the first outer surface 52A and the second outer surface 52B is maintained at the prescribed distance. Therefore, information is written to the IC chip 51 in a state where the positions of the electrical contact surfaces 511 in the first direction are in a stable state.

A particular feature of the embodiment is that information is written to the IC chip 51 in a state where the holder 52 is attached to the casing 11. Therefore, an inconsistency is unlikely to arise between the specifications of developer accommodated in the casing 11 and the information stored in the IC chip 51 after writing has been performed.

Further, the jig fixes the position of the holder 52 in the second direction relative to the casing 11. Therefore, in step S7, the probe 60 contacts the electrical contact surfaces 511 to write information to the IC chip 51 in a state where not only the position of the first outer surface 52A is fixed in the first direction relative to the casing 11 but also the position of the holder 52 is fixed in the second direction relative to the casing 11. Consequently, information can be more reliably written to the IC chip 51.

Subsequently, the manufacturer examines the information that has been written to the IC chip 51 (step S8). Specifically, the electrodes of an inspection tool are placed in contact with the electrical contact surfaces 511 on the IC chip 51. The inspection tool then reads the information stored in the IC chip 51 via the electrical contact surfaces 511, enabling the manufacturer to determine whether the information stored in the memory is correct.

<4. Variations>

While the present invention has been described with reference to a specific embodiment thereof, the present invention is not limited to the embodiment described above.

Figure 10:
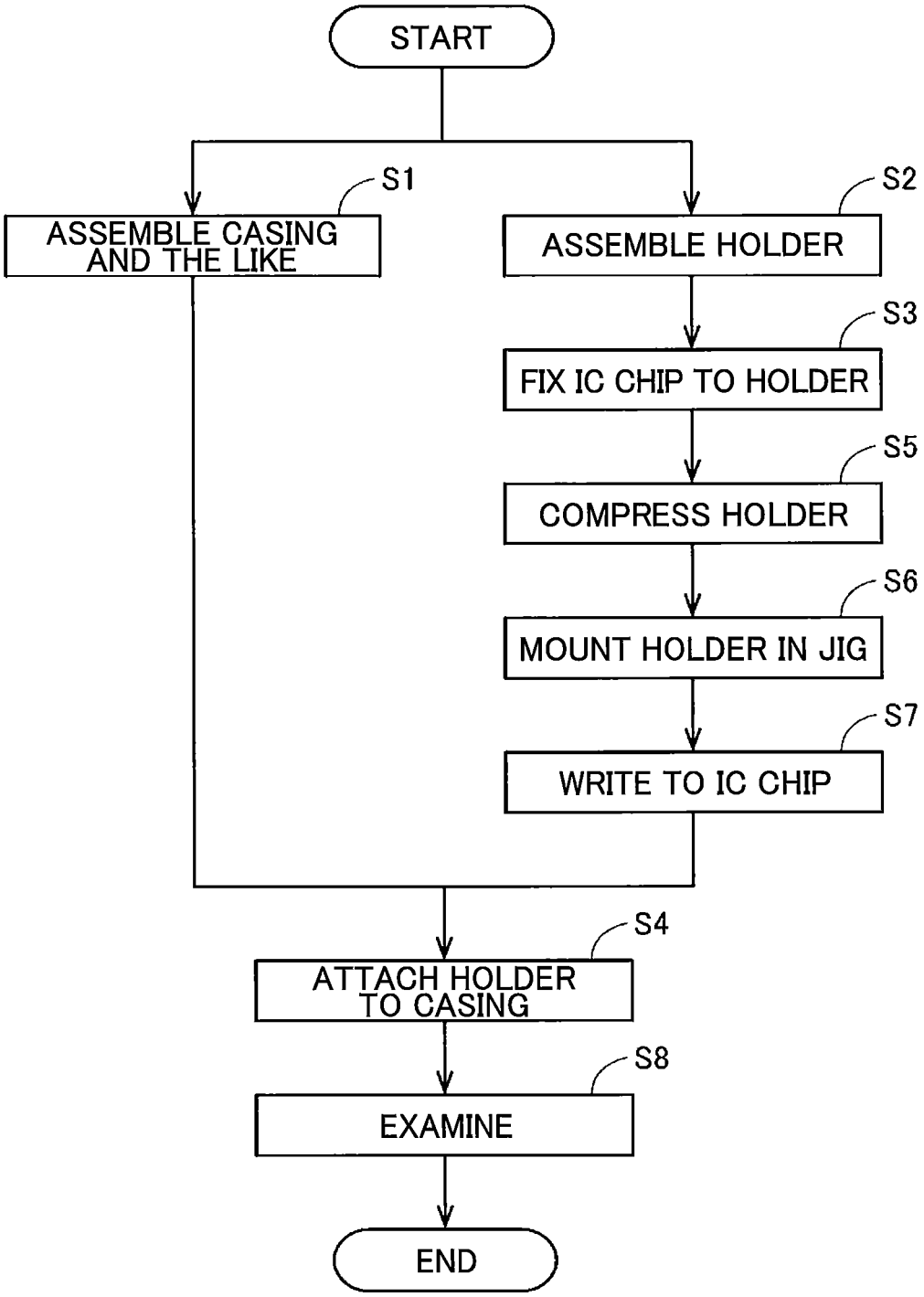
FIG. 10 is a flowchart illustrating a variation of the production procedure for the developing cartridge.

FIG. 10 is a flowchart illustrating a variation of the production procedure for the developing cartridge 1. In the example of FIG. 10, the order of steps S4 through S7 differs from that in the embodiment described above. In the example of FIG. 10, the manufacturer compresses the holder 52 in the first direction (step S5) and mounts the holder 52 in the jig (step S6) after completing step S3. Next, the manufacturer writes information to the IC chip 51 (step S7). Hence, in the example of FIG. 10, the manufacturer writes information to the IC chip 51 in a state where the holder 52 is not attached to the casing 11. After completing the writing, the manufacturer attaches the holder 52 to the casing 11 (step S4).

Since information is written to the IC chip 51 before attaching the holder 52 to the casing 11 in this way, the equipment used for writing information to the IC chip 51 can be more compact.

Further, the above-described embodiment describes a procedure used when the manufacturer is producing a new developing cartridge 1. However, when reusing a used developing cartridge 1, the operator may reproduce the IC chip assembly 50 by performing the process in steps S2-S8 described above. In this case, deleting information from the IC chip 51 or updating information in the IC chip 51 may be performed instead of writing information to the IC chip 51 in step S7. In other words, at least one of the operations for writing information to, deleting information from, and updating information in the IC chip 51 may be performed by bringing the probe 60 into contact with the electrical contact surfaces 511.

Further, the above-described embodiment describes the production or reproduction of the IC chip assembly 50 used in the developing cartridge 1. However, the IC chip assembly 50 may be a component used in another product. For example, the IC chip assembly 50 may be a component used in the drum cartridge 2.

Further, in the above-described embodiment, the coil spring 523 is employed as an elastic member. However, other kinds of springs such as a leaf spring, a torsion spring and the like are also available instead of the coil spring 523.

Further, according to the above-described embodiment, the IC chip having the electrical contact surfaces is fixed to the outer surface of the holder. However, only the electrical contact surfaces configured to contact the electrical connector may be fixed to the outer surface of the holder, while a remaining portion of the IC chip other than the electrical contact surfaces may be positioned at a different portion of the developing cartridge.

Further, each part and component constituting the image-forming apparatus may have a shape different from that of the above-described embodiment illustrated in the accompanying drawings. Further, parts and components described in the embodiment and variations described above may be appropriately combined as long as such combinations can avoid conflicting problem.

What is claimed is:

1. A method of production or reproduction of an assembly, the assembly including: a storage medium having an electrical contact surface; and a holder configured to hold the electrical contact surface, the holder having: a first outer surface positioned at one side in a first direction intersecting the electrical contact surface and configured to hold the electrical contact surface; a second outer surface positioned at another side in the first direction and apart from the first outer surface in the first direction; and an elastic member positioned between the first outer surface and the second outer surface and configured to expand and contract in the first direction, a separation distance in the first direction between the first outer surface and the second outer surface being changeable between a first distance and a second distance shorter than the first distance in accordance with expansion and contraction of the elastic member, the method comprising:

reducing the separation distance to a prescribed distance shorter than the first distance by compressing the elastic member in the first direction;

maintaining the separation distance at the prescribed distance; and performing at least one of writing information to, deleting information from, and updating information in the storage medium by bringing a probe into contact with the electrical contact surface in a state where the separation distance is maintained at the prescribed distance.

2. The method according to claim 1, wherein the prescribed distance is the second distance.

3. The method according to claim 1, wherein the prescribed distance is shorter than the first distance and longer than the second distance.

4. The method according to claim 1, further comprising fixing the electrical contact surface to the first outer surface, wherein the reducing is performed after the fixing is performed.

5. The method according to claim 1, wherein the holder is attachable to a casing configured to accommodate a developing agent, and wherein the performing is performed in a state where the holder is attached to the casing.

6. The method according to claim 5, further comprising attaching the holder to the casing before the performing is performed.

7. The method according to claim 5, wherein a developing roller is positioned at an end portion of the casing in a second direction, wherein the holder is movable in the second direction relative to the casing, and wherein the performing is performed in a state where a position of the holder is fixed in the second direction relative to the casing.

8. The method according to claim 1, wherein the holder is attachable to a casing configured to accommodate a developing agent, and wherein the performing is performed in a state where the holder is not attached to the casing.

9. The method according to claim 8, further comprising attaching the holder to the casing after the performing is performed in a state where the holder is not attached to the casing.

10. The method according to claim 1, wherein a jig presses at least one of the first outer surface and the second outer surface in the first direction to contract the elastic member in the first direction.

11. The method according to claim 10, wherein the jig presses a portion of the first outer surface encompassing the electrical contact surface.

12. The method according to claim 1, wherein in the performing, the information is written to the storage medium by bringing the probe into contact with the electrical contact surface.

13. The method according to claim 1, wherein in the performing, the information is updated in the storage medium by bringing the probe into contact with the electrical contact surface.

14. The method according to claim 1, wherein in the performing, the information is deleted from the storage medium by bringing the probe into contact with the electrical contact surface.

15. The method according to claim 1, wherein the first outer surface is configured to hold the storage medium including the electrical contact surface.

16. The method according to claim 1, wherein the storage medium is an IC chip.

17. The method according to claim 1, wherein the storage medium is used in a developing cartridge.

* * * * *